US012643639B2

(12) United States Patent
Imai

(10) Patent No.: US 12,643,639 B2
(45) Date of Patent: Jun. 2, 2026

(54) ELECTRICAL HYDROFOIL DEVICE AND POWER SUPPLY CABLE ASSEMBLLY THEREOF

(71) Applicant: Homare Imai, Taichung City (TW)

(72) Inventor: Homare Imai, Taichung City (TW)

( * ) Notice: Subject to any disclaimer, the term of this patent is extended or adjusted under 35 U.S.C. 154(b) by 461 days.

(21) Appl. No.: 18/504,179

(22) Filed: Nov. 8, 2023

(65) Prior Publication Data

US 2025/0145255 A1 May 8, 2025

(51) Int. Cl.

| | |
|---|---|
| ***B63B 32/10*** | (2020.01) |
| ***B63B 32/60*** | (2020.01) |
| ***B63B 32/73*** | (2020.01) |

(52) U.S. Cl.

CPC ..... *B63B 32/10* (2020.02); *B63B 32/60* (2020.02); *B63B 32/73* (2020.02)

(58) Field of Classification Search

CPC ..... B63B 32/10; B63B 32/60; B63B 32/73; B63H 21/17

See application file for complete search history.

(56) References Cited

U.S. PATENT DOCUMENTS

| | | | | |
|---|---|---|---|---|
| 12,157,551 | B2 * | 12/2024 | Dockray | B63H 8/16 |
| 2009/0120705 | A1 * | 5/2009 | McKinzie | A63C 17/08 180/181 |
| 2023/0140898 | A1 * | 5/2023 | Montague | H02K 5/132 440/6 |

FOREIGN PATENT DOCUMENTS

| | | | | |
|---|---|---|---|---|
| CN | 112455607 A | * | 3/2021 | B63B 32/60 |
| CN | 222272299 U | * | 12/2024 | |

* cited by examiner

*Primary Examiner* — Anthony D Wiest
(74) *Attorney, Agent, or Firm* — Leong C. Lei

(57) ABSTRACT

An electrical hydrofoil device, as well as an electrical power cable assembly thereof, is provided, including an electrical hydrofoil device including a hydrofoil watercraft having a propulsion unit, an electrical power box holding a battery and an electrical controller therein, an electrical power cable connected between the electrical power box and the propulsion unit, a body wearing article wearable on an operator's body, and a safety lanyard connecting between the body wearing article and the hydrofoil watercraft. The electrical power box is connected with the body wearing article to be carriable by the operator. Electrical power of the battery and a signal of the electrical controller are transmittable through the electrical power cable to the propulsion unit. The electrical power cable includes a helical curling portion formed of successive helically-wound coil turns stretchable to extend the length.

10 Claims, 5 Drawing Sheets

ELECTRICAL HYDROFOIL DEVICE AND POWER SUPPLY CABLE ASSEMBLLY THEREOF

BACKGROUND OF THE INVENTION

(a) Technical Field of the Invention

The present invention provides a water surface activity tool, and more particularly to an electrical hydrofoil device having a battery and an electrical controller separated therefrom to be carried by an operator and a power supply cable thereof.

(b) Description of the Prior Art

Prior art patent documents, such as Chinese Patent Document No. 202011415925.4 and U.S. patent Ser. No. 17/920,662, teach waterborne watercrafts, or electrical hydrofoil device. Both documents use batteries to supply electrical power to an electrical speed controller (ESC) or a propulsion unit. It is known that the electrical hydrofoil device is operated by controlling the advancing or turning with an operator's feet in combination with change of the gravity center of the body. Since the batteries and the ESC are mounted in the hydrofoil, the hydrofoil has to be thickened in order to accommodate the batteries and the ESC therein. Consequently, the hydrofoil becomes significantly heavy, and this, plus the combined weight of the batteries, the ESC, the mast, the propulsion unit, the front wings, and the rear wings, makes the total weight of the electrical hydrofoil device very heavy, causing undesired influence on the operation agility of the hydrofoil. Further, mounting the batteries and the ESC in the hydrofoil, which is generally of a substantial length, requires high technical capability of waterproofness. This makes further improvements to be made by the manufacturers.

SUMMARY OF THE INVENTION

The primary objective of the present invention is to arrange a battery and an electrical controller in an electrical power box to form a separate component, which can be carried by an operator, so that the overall weight of an electrical hydrofoil device can be greatly reduced to enhance the operation agility of the electrical hydrofoil device.

A secondary objective of the present invention is to provide an electrical power cable, which includes a helical curling portion, to electrically connect between an electrical power box that is personally carried and a propulsion unit, such that by means of the feature that the helical curling portion, when acted upon by a force, is stretchable to extend the length and, when not acted upon by the force, resumes the original shape, the connection between the electrical power cable and the electrical power box or the propulsion unit does not break in order to consistently transmit electrical power from a battery of the electrical power box and a signal from an electrical controller to the propulsion unit.

A further objective of the present invention is to provide an electrical power cable that includes a helical curling portion to connect between an electrical power box and a propulsion unit, and the helical curling portion may receive an end of a safety lanyard to extend therethrough and to be constrained in the helical curling portion, so that this, when used in combination with zip ties, helps manages a safety lanyard and the electrical power cable that are connected between an operator and a foil board as being combined together to allow the operation of the electrical hydrofoil device of the present invention is not impeded by the electrical power cable and the safety lanyard.

To achieve the above objectives, the present invention provides an electrical hydrofoil device, which comprises: a hydrofoil watercraft that comprises a propulsion unit, an electrical power box that receives and holds a battery and an electrical controller, an electrical power cable that is connected between the electrical power box and the propulsion unit, a body wearing article wearable on an operator's body, and a safety lanyard that connects between the body wearing article and the hydrofoil watercraft, wherein the electrical power box is connected with the body wearing article to be carriable by the operator; electrical power of the battery and a signal of the electrical controller are transmittable through the electrical power cable to the propulsion unit; the electrical power cable comprises a helical curling portion and a straight line portion, and the helical curling portion is formed of a plurality of successive helically-wound coil turns having a predetermined length, wherein the helical curling portion, when acted upon by a force, is stretchable to extend the length and when not acted upon the force, resumes the helically-wound coil turns to shorten the length.

Preferably, one end of the safety lanyard extends through each of the coil turns of the helical curling portion to connect to the body wearing article.

Preferably, the length of the helical curling portion of the electrical power cable, after being stretched, in combination with a length of the straight line portion exceeds a length of the safety lanyard.

Based on the above arrangement, the battery and the electrical controller are not received and held in the foil board of the hydrofoil watercraft, so that the thickness of the foil board can be reduce to reduce the weight, and thus, the total weight of the hydrofoil watercraft can be greatly reduced to therefore significantly improve the operation agility of the electrical hydrofoil device according to the present invention. And, due to the feature that the helical curling portion of the electrical power cable is stretchable to extend the length when acted upon by a force, and the length of the helical curling portion of the electrical power cable after being stretched, plus the length of the straight line portion, is greater than the length of the safety lanyard, the connection between the electrical power cable and the electrical power box or the propulsion unit will not be separated or broken.

DETAILED DESCRIPTION OF THE PREFERRED EMBODIMENTS

Figure 1:
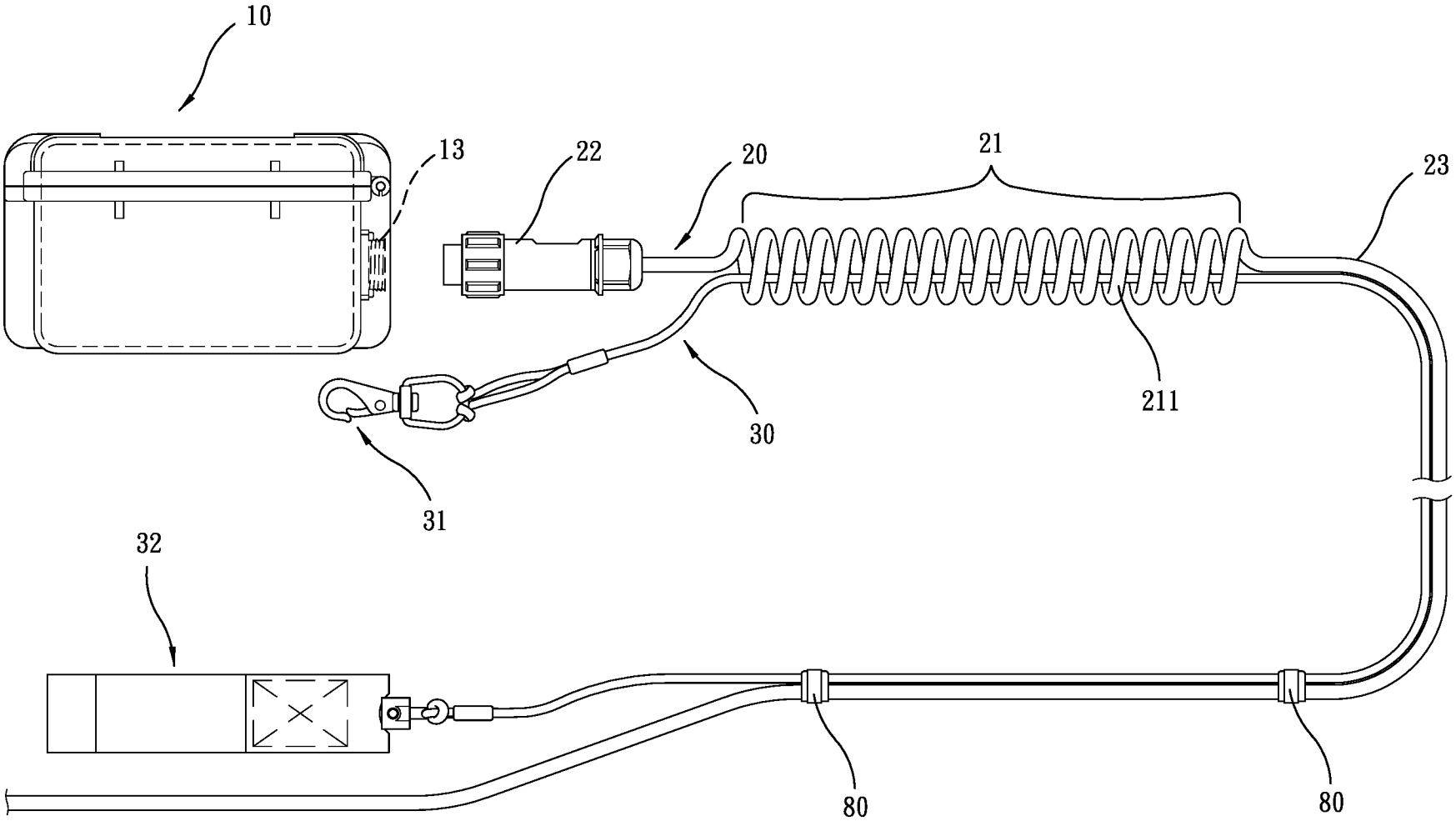
FIG. 1 is a schematic view showing an electrical power box, an electrical power cable, and a safety lanyard of the present invention.
Figure 2:
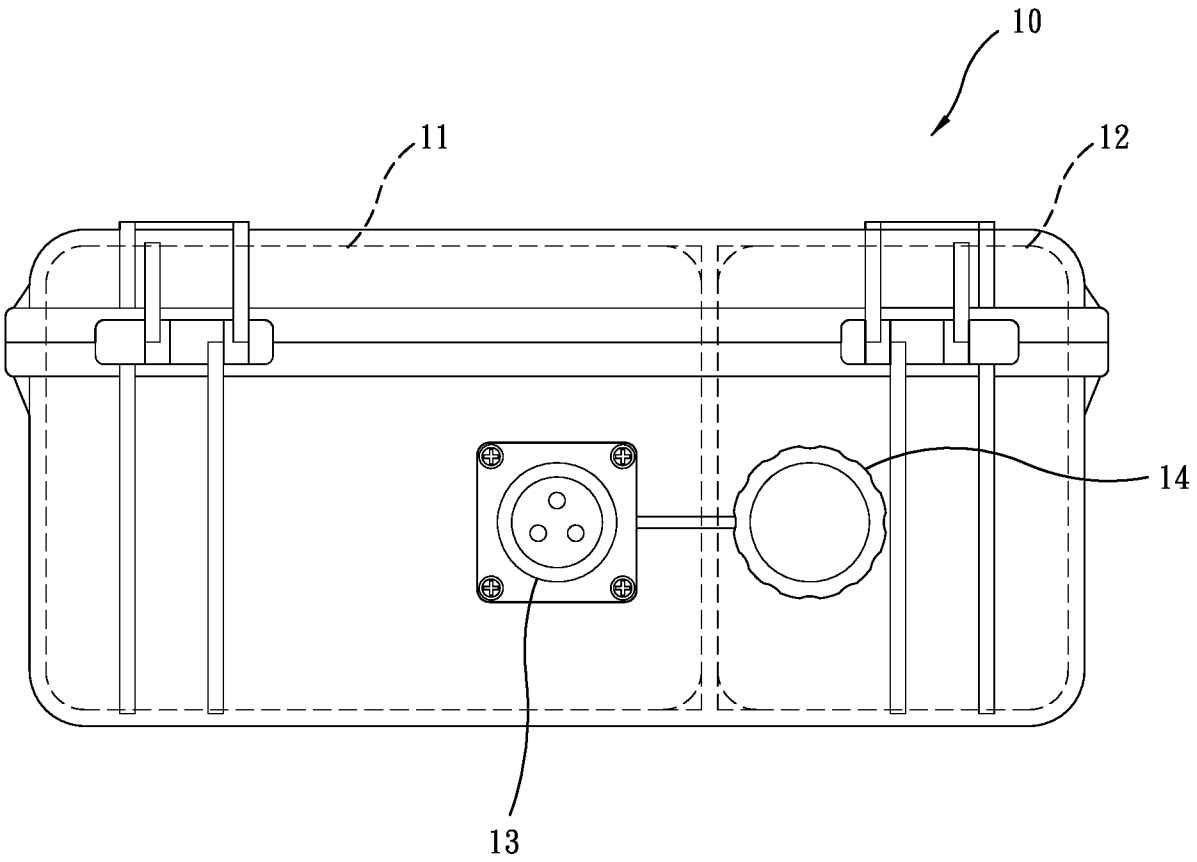
FIG. 2 is a schematic view showing the electrical power box of the present invention.
Figure 3:
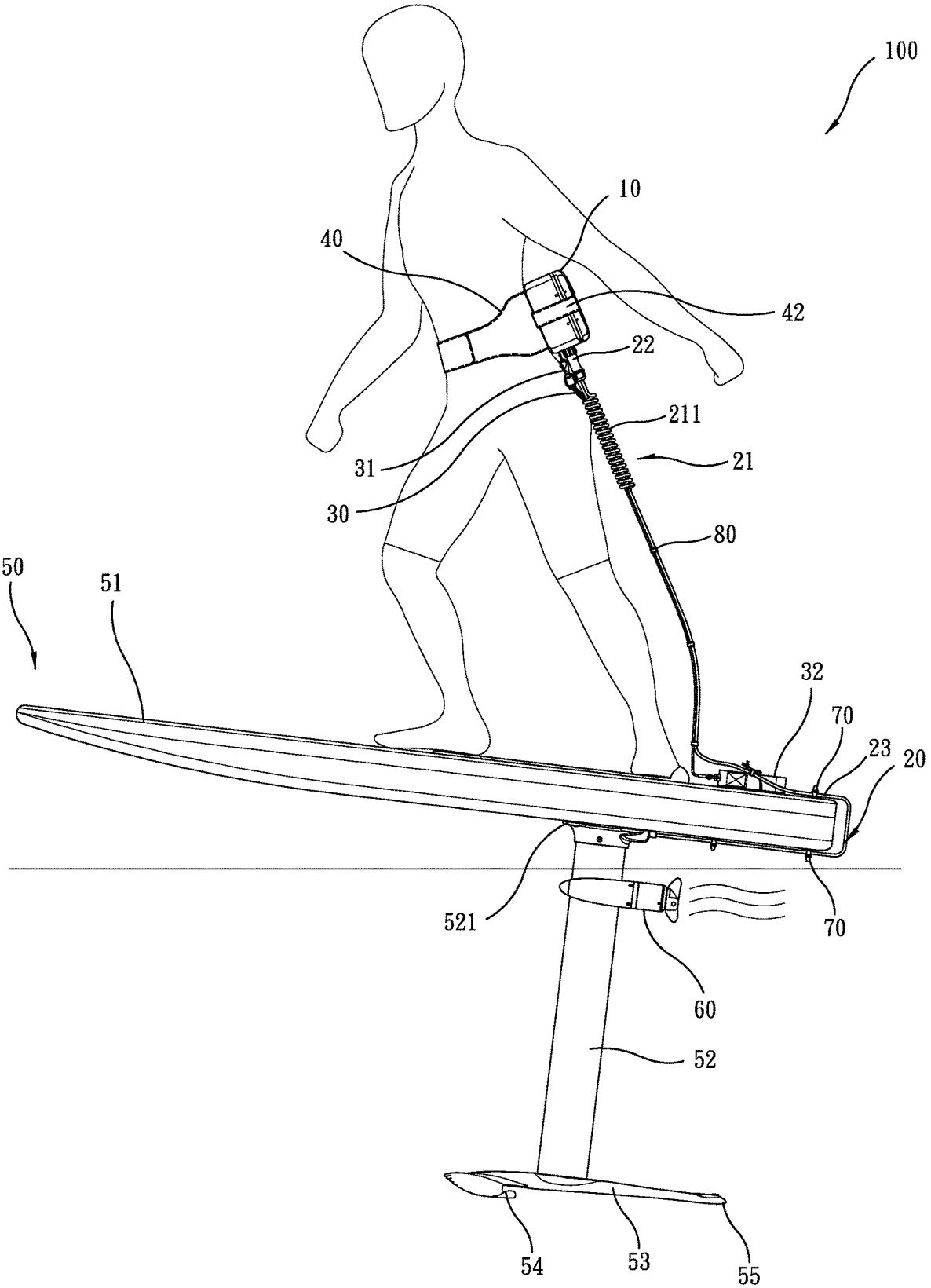
FIG. 3 is a schematic view showing a condition of use of the present invention.
Figure 4:
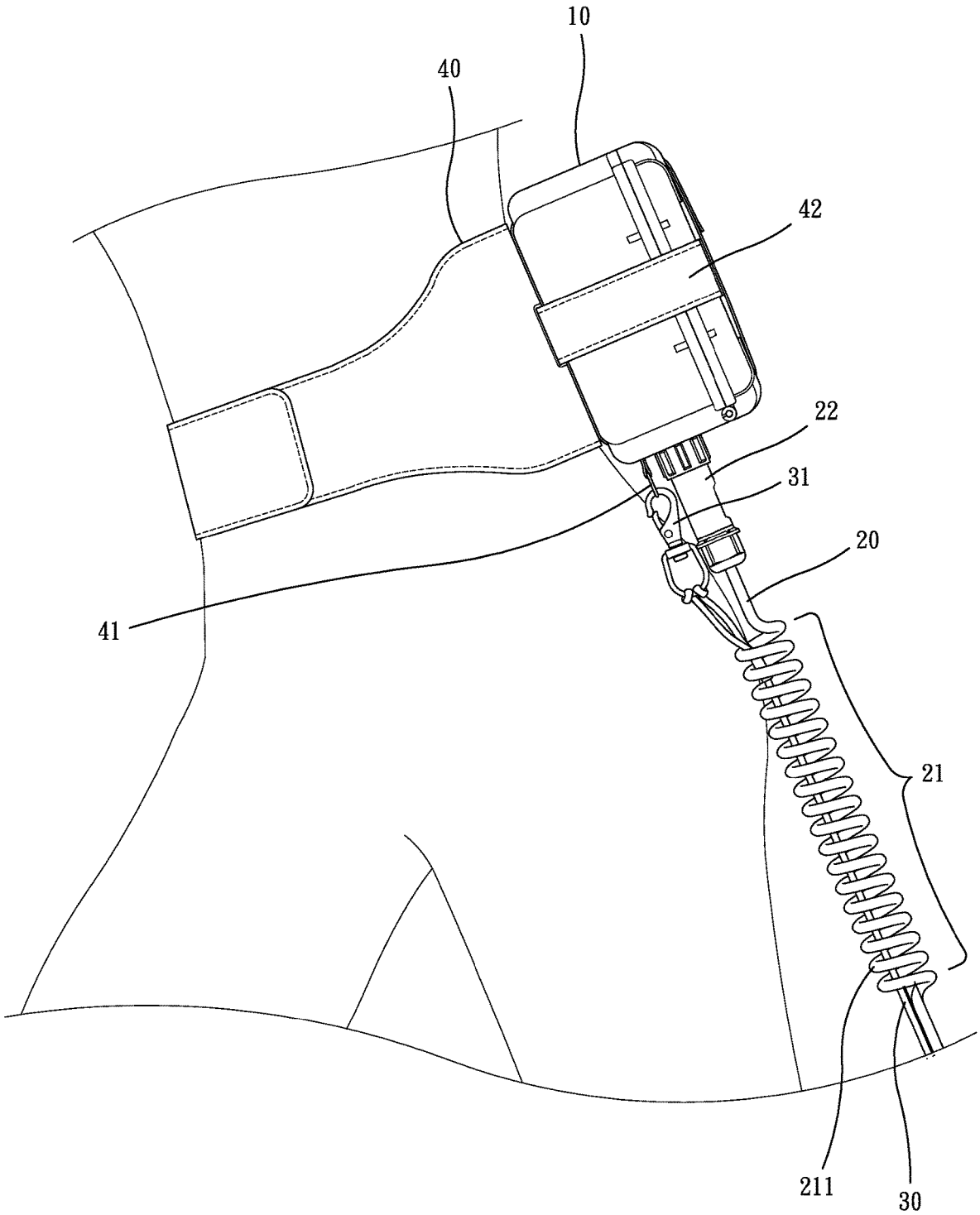
FIG. 4 is an enlarged view showing a portion of FIG. 3.
Figure 5:
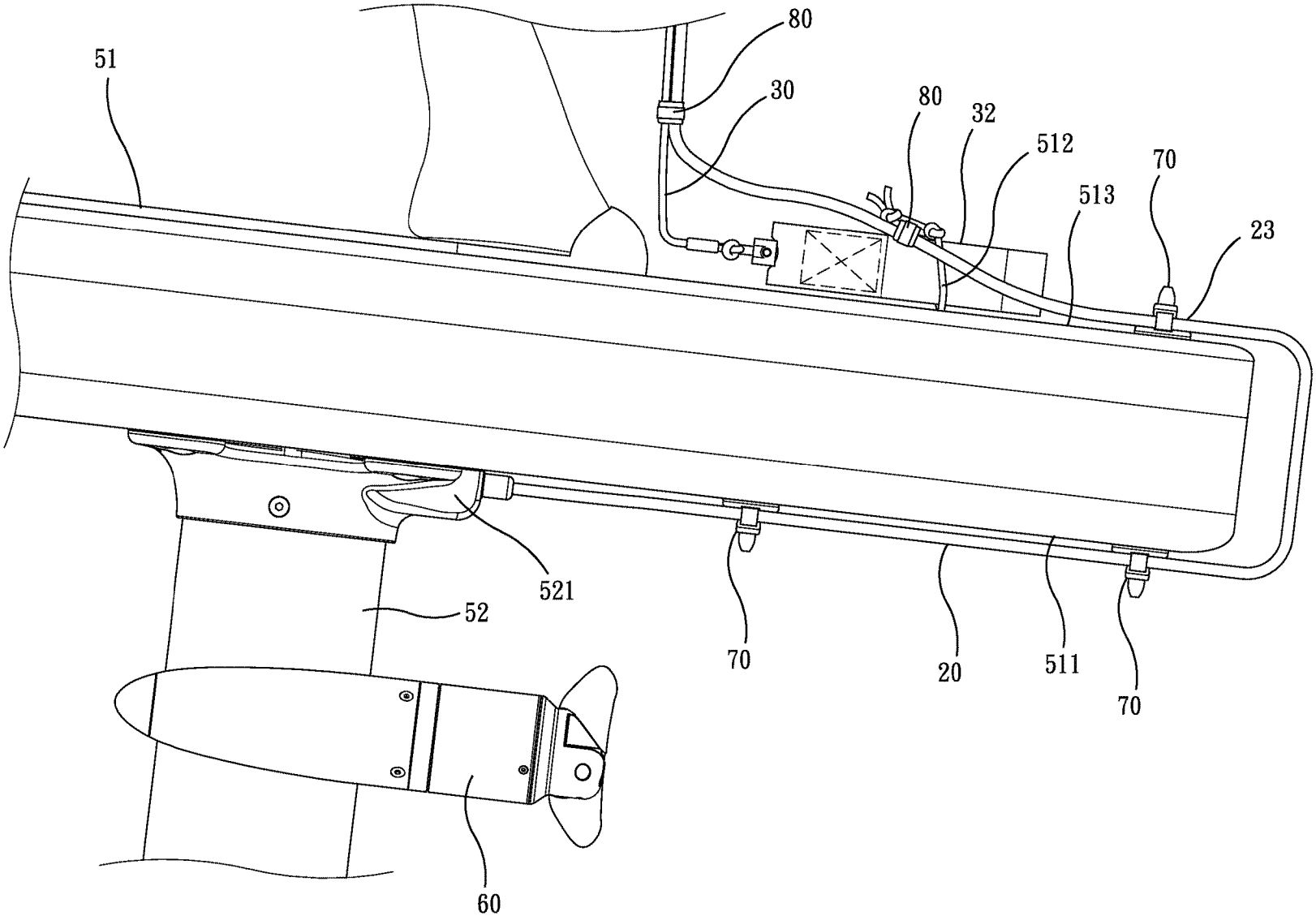
FIG. 5 is an enlarged view showing another portion of FIG. 3.

Referring to FIGS. 1-5, an electrical hydrofoil device 100 according to the instant embodiment comprises: a hydrofoil watercraft 50, an electrical power box 10, an electrical power cable 20, a body wearing article 40, and a safety lanyard 30.

The hydrofoil watercraft 50 comprises a foil board 51, and a foil board undersurface 511 is connected with a mast 52, and a top end of the mast 52 and the foil board undersurface 511 are connected to each other by means of a mounting seat 521 and are arranged to form a sealed and waterproof condition with respect to each other. A bottom end of the mast 52 is connected with a connection bar 53, and a front wing 54 is mounted to a front end of the connection bar 53 and a rear wing 55 is mounted to a rear end of the connection bar 53. A propulsion unit 60 is mounted on the mast 52. The foil board 51 is provided, at a location adjacent to a rear side thereof, with a fixing member 512, and in the instant embodiment, the fixing member 512 comprises a rope loop connected with and fixed to the foil board 51.

The electrical power box 10 has an interior in which a battery 11 and an electrical controller 12 are received, wherein the battery 11 and the electrical controller 12 are in electrical connection with each other, and is provided, on an outside surface thereof, with a first electrical connector 13, wherein the first electrical connector 13 is in electrical connection with the battery 11 and the electrical controller 12. The electrical power box 10 is kept in a sealed and waterproof condition when closed.

The electrical power cable 20 comprises a helical curling portion 21 and a straight line portion 23, and has an end that is provided with a second electrical connector 22 connectable with the first electrical connector 13 of the electrical power box 10, wherein the first electrical connector 13 and the second electrical connector 22, when connected, are kept in a sealed and waterproof condition, and an opposite end electrically connected to the propulsion unit 60. The helical curling portion 21 is formed of a plurality of successive helically-wound coil turns 211 having a predetermined length. The helical curling portion 21, when acted upon by a force, is stretchable to become straightened, and when not acted upon by the force, resumes the helically-wound coil turns 211 to become shortened. The helical curling portion 21 is arranged adjacent to the end associated with the second electrical connector 22, and the straight line portion 23, which is extended in a line form and is arbitrarily bendable, is arranged at another end of the electrical power cable 20 that is opposite to the helical curling portion 21, such that tolerance is provided between the straight line portion 23 and an operator to allow the operator not to be interfered with by the electrical power cable 20 in changing the body posture. A portion of the straight line portion 23 that is close to a rear side of the foil board 51 is attached to a foil board top surface 513 and is subsequently curved and extended to the foil board undersurface 511 to finally extend into the mounting seat 521 to be electrically connected, in an interior of the mast 52, to the propulsion unit 60 so as to allow electrical power of the battery 11 and signals of the electrical controller 12 to transmit to the propulsion unit 60 to command the propulsion unit 60 to operate for moving the electrical hydrofoil device 100 forward. A connection portion where the electrical power cable 20 extends into the mounting seat 521 is set in a sealed and waterproof condition. A plurality of zip tie holders 70 are arranged, at intervals, along the foil board top surface 513 and the foil board undersurface 511 and the straight line portion 23 of the electrical power cable 20 is fixed to the zip tie holders 70. A zip tie 80 is applied to fasten the straight line portion 23 of the electrical power cable 20 to the fixing member 512 (rope loop).

The body wearing article 40 is wearable on the body of an operator. The body wearing article 40 is connectable with or detachable from the electrical power box 10. In the instant embodiment, the body wearing article 40 comprises a waist fastening band. The body wearing article 40 (waist fastening band) and the electrical power box 10 are connected with each other by means of a fourth fastening member 42. In the instant embodiment, the fourth fastening member 42 comprises a hook-and-loop fastening strip. The body wearing article 40 is further provided with a third fastening member 41, and in the instant embodiment, the third fastening member 41 comprises a clip ring.

The safety lanyard 30 has an end that is provided with a first fastening member 31 and an opposite end that is provided with a second fastening member 32. In the instant embodiment, the first fastening member 31 comprises a clip, and the second fastening member 32 comprises a piece of powerful hook-and-loop fastening strip. The end associated with the first fastening member 31 is inserted into the helical curling portion 21 of the electrical power cable 20 through one end thereof to subsequently extend out of the helical curling portion 21 from an opposite end thereof and is connected with and attached to the third fastening member 41 of the body wearing article 40; and the second fastening member 32 is connected with and fixed to the fixing member 512 of the foil board 51. A length of the helical curling portion 21 of the electrical power cable 20, after being stretched, plus a length of the straight line portion 23, is greater than a length of the safety lanyard 30. The safety lanyard 30 and the straight line portion 23 of the electrical power cable 20 are combined with each other by means of a plurality of zip ties 80 arranged at intervals to make the safety lanyard 30 and the straight line portion 23 of the electrical power cable 20 not randomly entangled with each other. A tolerance is similarly present between the safety lanyard 30 and the operator to allow the operator not to be interfered with by the safety lanyard 30 in changing the body posture.

Thus, the above provide an introduction to all the components that make up the electrical hydrofoil device 100 provided in a preferred embodiment, as well as the assembly thereof, and in the following features of operation thereof will be described.

In the following, reference is made to FIGS. 1-5. The electrical hydrofoil device 100 of the instant embodiment is such that the battery 11 and the electrical controller 12 are received and held in the electrical power box 10 to make the electrical power box 10 an independent and separate component that is carriable personally by the operator, with the electrical power cable 20 arranged to connect between the electrical power box 10 and the propulsion unit 60 to allow the electrical power of the battery 11 and the signals of the electrical controller 12 to transmit to the propulsion unit 60, whereby people are allowed to enjoy water activities by using the electrical hydrofoil device 100 according to the instant embodiment.

Since the battery 11 and the electrical controller 12 are not installed in the foil board 51, the thickness of the foil board 51 can be reduced to thereby reduce the weight of the foil board 51 itself. Compared to the prior art, the electrical hydrofoil device 100 of the instant embodiment can reduce the weight of the foil board 51 itself, and can also remove the weights of the battery 11 and the electrical controller 12, so that the total weight of the electrical hydrofoil device 100 according to the instant embodiment is greatly reduced to thereby significantly improve agility of operation thereof.

Further, in doing a water activity, the operator may accidently fall off the foil board 51, and in case that the operator falls, since the length of the safety lanyard 30 is made shorter than the stretched length of the helical curling portion 21 in combination with the length of the straight line portion 23, when the safety lanyard 30 and the electrical power cable 20 are both pulled, the safety lanyard 30 will be first pulled apart so as to prevent the electrical power cable 20 from being overly pulled and also to prevent the foil board 51 from moving far away from the operator. In case that the electrical power cable 20 is separately pulled, the helical curling portion 21 may receive the force acting thereon and become stretched to prevent the connection between the electrical power cable 20 and the electrical power box 10 or the propulsion unit 60 from being broken.

Since one end of the safety lanyard 30 is extended through the coil turns 211 of the helical curling portion 21 of the electrical power cable 20, the end of the safety lanyard is constrained in the helical curling portion 21, while the plurality of the zip ties 80 are applied to combine the opposite end of the safety lanyard 30 and the straight line portion 23 of the electrical power cable 20 with each other as a united arrangement, so that, on the one hand, the straight line portion 23 of the electrical power cable 20 and the safety lanyard are prevented from entangling together, and on the other hand, the operator is prevented from being impeded by the electrical power cable 20 and the safety lanyard 30.

I claim:

1. An electrical hydrofoil device, comprising a hydrofoil watercraft that comprises a propulsion unit, an electrical power box that receives and holds a battery and an electrical controller, an electrical power cable that is connected between the electrical power box and the propulsion unit, a body wearing article wearable on an operator's body, and a safety lanyard that connects between the body wearing article and the hydrofoil watercraft, wherein the electrical power box is connected with the body wearing article to be carriable by the operator; the battery and the electrical controller are in electrical connection with each other, and electrical power of the battery and a signal of the electrical controller are transmittable through the electrical power cable to the propulsion unit; the electrical power cable comprises a helical curling portion and a straight line portion, and the helical curling portion is formed of a plurality of successive helically-wound coil turns having a predetermined length, wherein the helical curling portion of the electrical power cable, when acted upon by a force, is stretchable to extend the length and when not acted upon the force, resumes the helically-wound coil turns to shorten the length.

2. The electrical hydrofoil device according to claim 1, wherein one end of the safety lanyard extends through each of the coil turns of the helical curling portion to connect to the body wearing article.

3. The electrical hydrofoil device according to claim 1, wherein the length of the helical curling portion of the electrical power cable, after being stretched, in combination with a length of the straight line portion exceeds a length of the safety lanyard.

4. The electrical hydrofoil device according to claim 1, wherein the electrical power box is provided on an outside surface with a first electrical connector, the first electrical connector being in electrical connection with the battery and the electrical controller; and the electrical power cable is provided, at one end thereof, with a second electrical connector, the second electrical connector being connectable with the first electrical connector.

5. The electrical hydrofoil device according to claim 1, wherein the hydrofoil watercraft comprises a foil board, a foil board undersurface being connected with a mast, a top end of the mast being connected to the foil board undersurface, a bottom end of the mast being connected with a connection bar, a front wing provided at a front end of the connection bar, a rear wing provided at a rear end of the connection bar, the propulsion unit being mounted to the mast, a plurality of zip tie holders arranged at intervals on a foil board top surface and the foil board undersurface to have the straight line portion of the electrical power cable fixed on the zip tie holders, the safety lanyard and the straight line portion of the electrical power cable being combined with each other by means of a plurality of zip ties.

6. The electrical hydrofoil device according to claim 1, wherein the safety lanyard has one end that is provided with a first fastening member and an opposite end that is provided with a second fastening member, and the body wearing article comprises a fourth fastening member and a third fastening member, the first fastening member of the safety lanyard being connectable to the third fastening member of the body wearing article, the second fastening member of the safety lanyard being connected with the hydrofoil watercraft, the body wearing article and the electrical power box being connectable with each other by means of the fourth fastening member.

7. An electrical power cable assembly of an electrical hydrofoil device, which comprises an electrical power cable and a safety lanyard, wherein the electrical power cable comprises a helical curling portion and the straight line portion, and has an end that is provided with a second electrical connector to connect to an electrical power box and an opposite end is electrically connected to a propulsion unit, the helical curling portion being formed of a plurality of successive helically-wound coil turns having a predetermined length, wherein the helical curling portion, when acted upon by a force, is stretchable to extend the length and when not acted upon the force, resumes the helically-wound coil turns to shorten the length; and wherein the safety lanyard has one end that is provided with a first fastening member and an opposite end that is provided with a second fastening member, the first fastening member penetrating into the helical curling portion of the electrical power cable through one end thereof to extend out of the helical curling portion through an opposite end thereof to be connected with and fixed to a body wearing article, the second fastening member being connected with and fixed to a foil board.

8. The electrical power cable assembly of the electrical hydrofoil device according to claim 7, wherein the length of the helical curling portion of the electrical power cable, after being stretched, in combination with a length of the straight line portion exceeds a length of the safety lanyard.

9. The electrical power cable assembly of the electrical hydrofoil device according to claim 7, wherein the safety lanyard and the straight line portion of the electrical power cable are combined with each other by means of a plurality of zip ties.

10. The electrical power cable assembly of the electrical hydrofoil device according to claim 7, wherein the first fastening member of the safety lanyard comprises a clip ring, and the second fastening member of the safety lanyard comprises a piece of powerful hook-and-loop fastening strip.

* * * * *